US011624134B2

(12) United States Patent
Bartys et al.

(10) Patent No.: US 11,624,134 B2
(45) Date of Patent: Apr. 11, 2023

(54) KNITTED COMPONENT WITH RAISED STRUCTURE AND METHODS OF MANUFACTURE

(71) Applicant: Nike, Inc., Beaverton, OR (US)

(72) Inventors: Samuel L. Bartys, London (GB); Nicola A. Danby, London (GB); JoseLuis Mariscal, Portland, OR (US); Seth M. Wiberg, Beaverton, OR (US)

(73) Assignee: NIKE, Inc., Beaverton, OR (US)

( * ) Notice: Subject to any disclaimer, the term of this patent is extended or adjusted under 35 U.S.C. 154(b) by 0 days.

(21) Appl. No.: 17/834,546

(22) Filed: Jun. 7, 2022

(65) Prior Publication Data

US 2022/0298683 A1 Sep. 22, 2022

Related U.S. Application Data

(63) Continuation of application No. 16/509,779, filed on Jul. 12, 2019, now Pat. No. 11,384,459.

(60) Provisional application No. 62/747,981, filed on Oct. 19, 2018.

(51) Int. Cl.

| | |
|---|---|
| ***D04B 1/24*** | (2006.01) |
| ***A43B 1/04*** | (2022.01) |
| ***A43B 23/02*** | (2006.01) |

(52) U.S. Cl.

CPC ..... *D04B 1/24* (2013.01); *A43B 1/04* (2013.01); *A43B 23/0205* (2013.01); *A43B 23/025* (2013.01); *D10B 2501/043* (2013.01)

(58) Field of Classification Search

CPC ... D04B 1/22; D04B 1/24; D04B 1/16; D04B 1/102; A43B 1/04; A43B 23/0205; D10B 2501/043; D10B 2403/0231

See application file for complete search history.

(56) References Cited

U.S. PATENT DOCUMENTS

| | | | | |
|---|---|---|---|---|
| 2,757,434 | A | 8/1956 | Mccord et al. | |
| 3,071,165 | A | 1/1963 | Truslow et al. | |
| 3,359,610 | A | 12/1967 | Faircloth | |
| 3,835,512 | A | 9/1974 | Piller et al. | |
| 7,235,504 | B2 | 6/2007 | Shirasaki et al. | |
| 7,396,784 | B2 | 7/2008 | Thiriot | |
| 7,565,821 | B2 * | 7/2009 | Park | D04B 21/04 66/195 |

(Continued)

FOREIGN PATENT DOCUMENTS

| | | | |
|---|---|---|---|
| CN | 104131399 | A | 11/2014 |
| CN | 107614768 | A | 1/2018 |

(Continued)

*Primary Examiner* — Danny Worrell

(74) *Attorney, Agent, or Firm* — Shook, Hardy and Bacon L.L.P.

(57) ABSTRACT

A knitted component including a first knit layer of a first yarn and a second knit layer of a second yarn. The second knit layer and the first knit layer are at least partially coextensive with each other and form a pocket between the first and second knit layers. A third yarn is at least partially positioned within the pocket and between the first and second knit layer. The third yarn includes first and second strands having at least one different property. The third yarn is secured to the first knit layer at a first location within the pocket and to the second knit layer at a second location within the pocket, and forms an x-shape configuration.

20 Claims, 6 Drawing Sheets

(56) References Cited

U.S. PATENT DOCUMENTS

| | | | | |
|---|---|---|---|---|
| 7,932,194 | B2 | 4/2011 | Bader et al. | |
| 8,595,878 | B2 | 12/2013 | Huffa et al. | |
| 9,375,049 | B2 | 6/2016 | Hazenberg et al. | |
| 9,668,530 | B2 | 6/2017 | Miller et al. | |
| 10,544,528 | B2 | 1/2020 | Tuscia et al. | |
| 10,945,482 | B2 * | 3/2021 | Schoppel | D04B 21/145 |
| 11,384,459 | B2 * | 7/2022 | Bartys | D04B 1/12 |
| 2002/0104335 | A1 * | 8/2002 | Shirasaki | D04B 21/02 66/196 |
| 2007/0144221 | A1 | 6/2007 | Sytz | |
| 2018/0055137 | A1 | 3/2018 | Fraser et al. | |
| 2018/0135213 | A1 | 5/2018 | Bell et al. | |
| 2019/0116914 | A1 | 4/2019 | Schoppel et al. | |
| 2019/0313728 | A1 | 10/2019 | Berrian et al. | |
| 2020/0022447 | A1 | 1/2020 | Durrell et al. | |
| 2020/0022456 | A1 | 1/2020 | Brinkman et al. | |
| 2020/0121019 | A1 | 4/2020 | Bartys et al. | |

FOREIGN PATENT DOCUMENTS

| | | | |
|---|---|---|---|
| DE | 102014006212 | A1 | 12/2014 |
| JP | 52-108377 | U | 8/1977 |

* cited by examiner

KNITTED COMPONENT WITH RAISED STRUCTURE AND METHODS OF MANUFACTURE

CROSS-REFERENCE TO RELATED APPLICATION

This application is a continuation of U.S. application Ser. No. 16/509,779, filed Jul. 12, 2019, which claims the benefit of priority under 35 U.S.C. § 119(e) to U.S. Provisional Application Ser. No. 62/747,981, filed Oct. 19, 2018, each of which is incorporated by reference in its entirety herein.

BACKGROUND

A variety of articles are formed from textiles. As examples, articles of apparel (e.g., shirts, pants, socks, footwear, jackets and other outerwear, briefs and other undergarments, hats and other headwear), containers (e.g., backpacks, bags), and upholstery for furniture (e.g., chairs, couches, car seats) are often at least partially formed from textiles. These textiles are often formed by weaving or interlooping (e.g., knitting) a yarn or a plurality of yarns, usually through a mechanical process involving looms or knitting machines. One particular object that may be formed from a textile is an upper for an article of footwear.

Conventional articles of footwear generally include two primary elements: an upper and a sole structure. The upper is secured to the sole structure and forms a void within the article of footwear for comfortably and securely receiving a foot. The sole structure is secured to a lower surface of the upper so as to be positioned between the upper and the ground. In some articles of athletic footwear, for example, the sole structure may include a midsole and an outsole. The midsole may be formed from a polymer foam material that attenuates ground reaction forces to lessen stresses upon the foot and leg during walking, running, and other ambulatory activities. The outsole may be secured to a lower surface of the midsole and forms a ground-engaging portion of the sole structure that is formed from a durable and wear-resistant material.

The upper of the article of footwear generally extends over the instep and toe areas of the foot, along the medial and lateral sides of the foot, and around the heel area of the foot. Access to the void on the interior of the upper is generally provided by an ankle opening in a heel area of the footwear. A lacing system is often incorporated into the upper to adjust the fit of the upper, thereby facilitating entry and removal of the foot from the void within the upper. The upper may include a tongue that extends under the lacing system to enhance adjustability of the footwear, and the upper may incorporate a heel counter to limit movement of the heel.

DESCRIPTION OF THE DRAWINGS

The embodiments will be further described in connection with the attached drawings. It is intended that the drawings included as a part of this specification be illustrative of the exemplary embodiments and should in no way be considered as a limitation on the scope of the present disclosure. Indeed, the present disclosure specifically contemplates other embodiments not illustrated but intended to be included in the claims.

DETAILED DESCRIPTION

Figure 1:
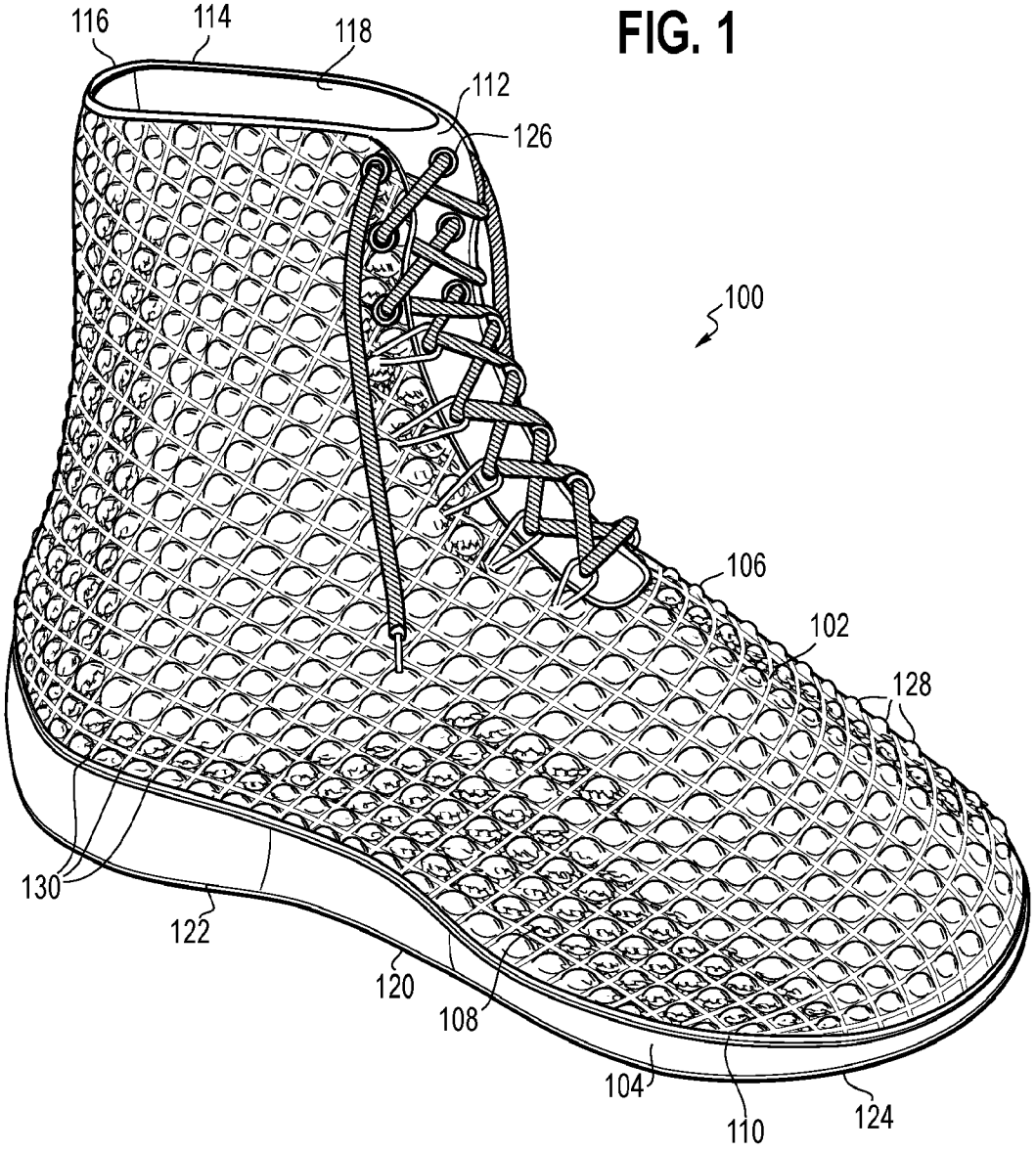
FIG. 1 is an illustration showing a perspective view of an article of footwear incorporating a knitted component with raised structures in accordance with certain aspects of the present disclosure.

Various aspects are described below with reference to the drawings in which like elements generally are identified by like numerals. The relationship and functioning of the various elements of the aspects may better be understood by reference to the following detailed description. However, aspects are not limited to those illustrated in the drawings or explicitly described below. It also should be understood that the drawings are not necessarily to scale, and in certain instances details may have been omitted that are not necessary for an understanding of aspects disclosed herein, such as conventional fabrication and assembly.

Certain aspects of the present disclosure relate to articles at least partially formed from textiles. One example of an article is an article of apparel (e.g., shirts, pants, socks, footwear, jackets and other outerwear, briefs and other undergarments, hats and other headwear, or the like). The article may be an upper configured for use in an article of footwear. The upper may be used in connection with any type of footwear. Illustrative, non-limiting examples of articles of footwear include a basketball shoe, a biking shoe, a cross-training shoe, a global football (soccer) shoe, an American football shoe, a bowling shoe, a golf shoe, a hiking shoe, a ski or snowboarding boot, a tennis shoe, a running shoe, and a walking shoe. The upper may also be incorporated into a non-athletic shoe, such as a dress shoe, a loafer, and a sandal.

One aspect of the present invention includes a knitted component having a first knit layer and a second knit layer that are at least partially coextensive with each other and form a pocket. A third yarn is at least partially positioned within the pocket and between the first knit layer and the second knit layer. The third yarn is secured to the first knit layer at a first location in the pocket and to the second knit layer at a second location in the pocket.

One or more aspects of the present invention provide the advantage of forming a knitted component having at least one raised structure formed of a first knit layer, a second knit layer and a third yarn that is at least partially positioned between the first knit layer and the second knit layer. The third yarn of the knitted component is visible through the second knit layer at at least one location of the at least one raised structure.

One or more aspects of the present invention provide the advantage of forming a knitted component for an upper of an article of footwear having a plurality of raised structures, wherein a color of the raised structure is visible from an exterior surface of the upper and may vary based on the structure, the configuration and the location of at least one yarn within the raised structure.

Figure 2:
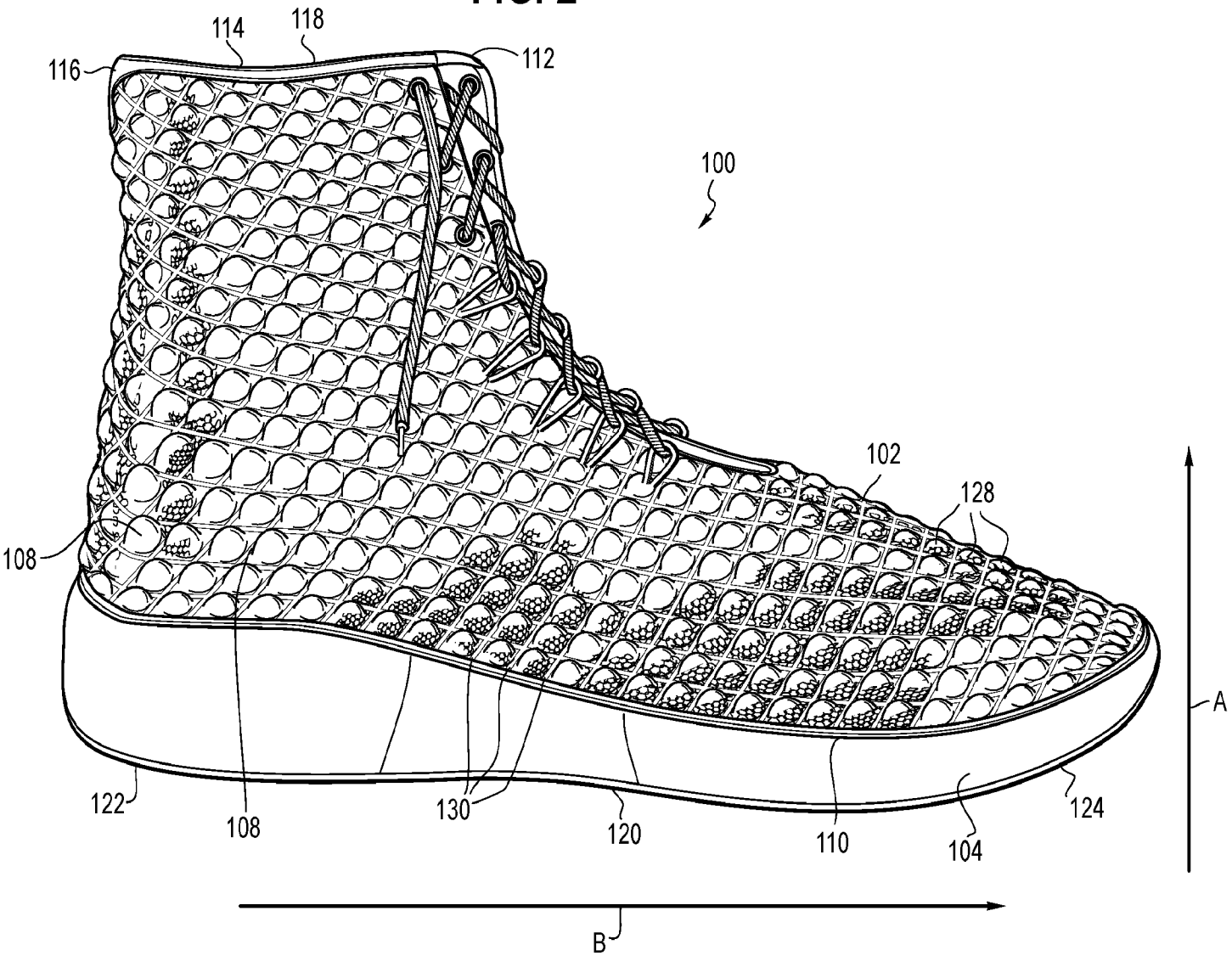
FIG. 2 is an illustration showing a medial side view of the article of footwear of FIG. 1.

Referring to FIGS. 1-2, an article of footwear 100 may include an upper 102 secured to a sole structure 104. The upper 102 may include a lateral side 106 and a medial side 108. The area of the shoe where the sole structure 104 joins the upper 102 may be referred to as the biteline 110. The upper 102 may be joined to the sole structure 104 in a fixed manner using any suitable technique, such as through the use of an adhesive, by sewing, etc. It is contemplated that the upper 102 may extend partially or completely around the foot of a wearer and/or may be integral with the sole, and a sockliner may or may not be used. In some embodiments, the sole structure 104 may include a midsole (not shown) and an outsole.

The article of footwear 100 may additionally include a throat area 112 and an ankle opening 114, which may be surrounded by a collar 116 and may lead to a void 118. The void 118 of the article of footwear 100 may be configured to accommodate a foot of a person. The throat area 112 may be generally disposed in a midfoot area 120 of the upper 102. The midfoot area 120 is generally an area of the upper 102 located between a heel area 122 and a toe area 124. In some embodiments, a tongue may be disposed in the throat area 112, but a tongue is an optional component. The tongue may be any type of tongue, such as a gusseted tongue or a burrito tongue. If a tongue is not included, the lateral and medial sides of the throat area 112 may be joined together. As shown, in some embodiments, the article of footwear 100 may include an optional fastening element, such as a lace (which may be associated with the lace apertures 126). Any suitable type of fastening element may be used.

Figure 3:
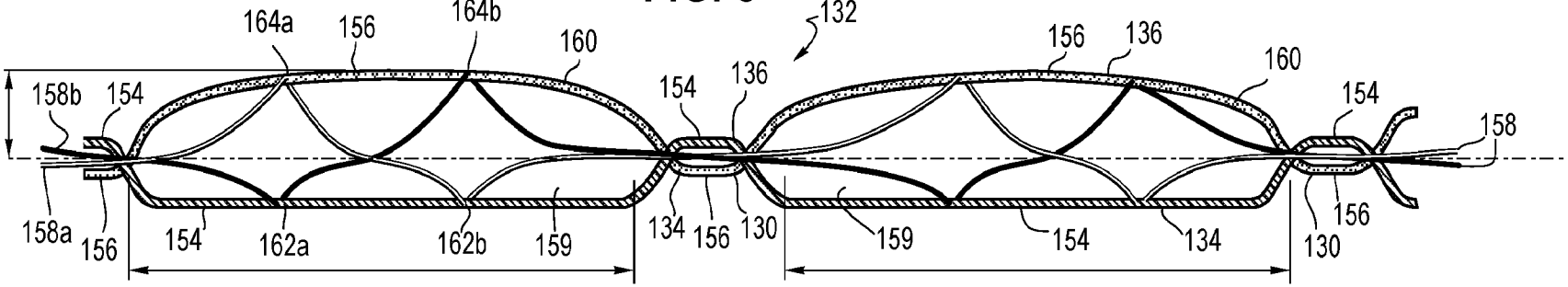
FIG. 3 is an illustration showing a cross-sectional view of three layers of a knitted component in a flat orientation and prior to a stimulus step in accordance with certain aspects of the present disclosure.
Figure 4:
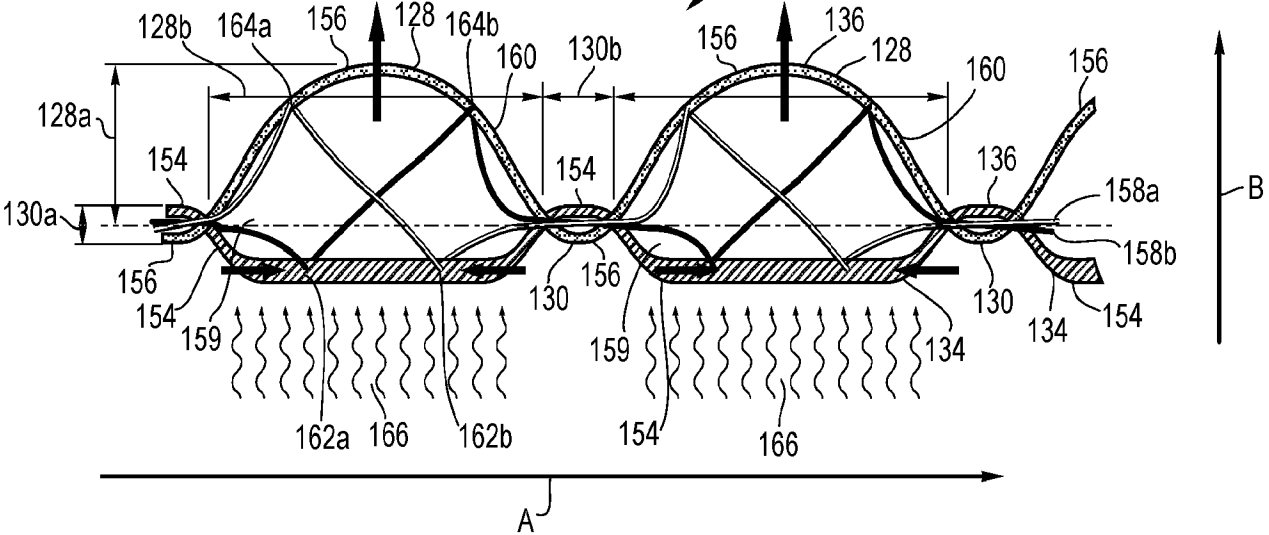
FIG. 4 is an illustration showing the knitted component of FIG. 3 during a stimulus step in accordance with certain aspects of the present disclosure.
Figure 5:
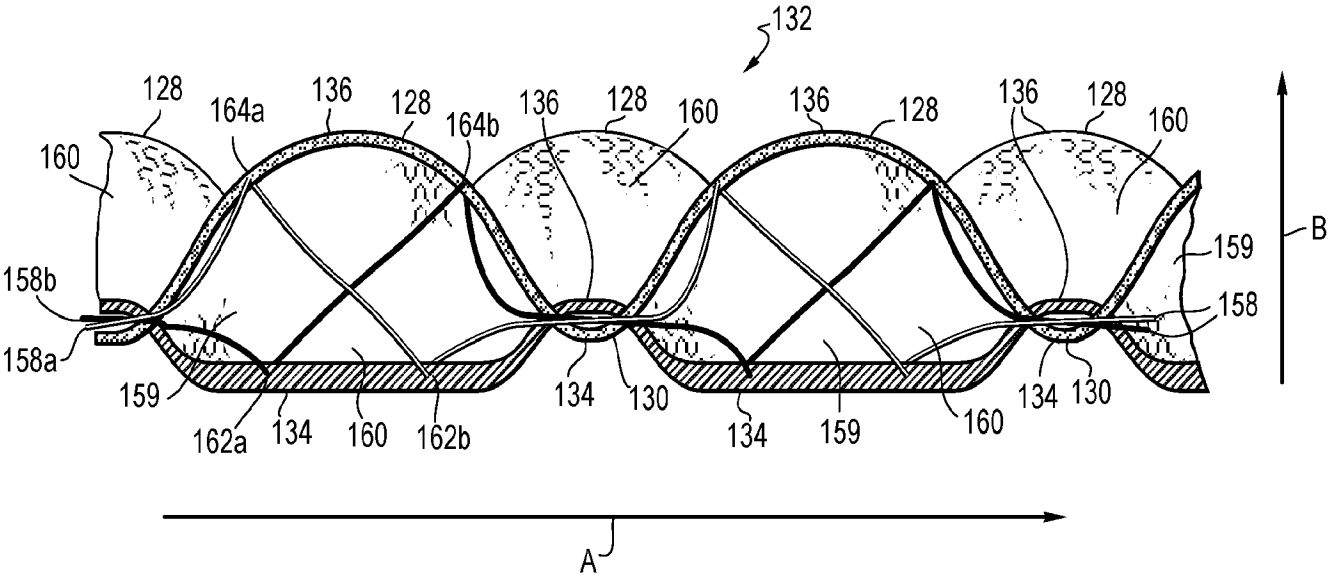
FIG. 5 is an illustration showing a side view of a knitted component after the stimulus step in accordance with certain aspects of the present disclosure.

The upper 102 may further include one or more structures, including but not limited to, at least one pod 160 with at least one raised structure 128. Referring to FIGS. 3-5, the pod 160 includes at least one side demarcated by an edge region, such as a second area 130. As described in more detail below, a stimulus (e.g., heat or steam) may be applied to the upper 102 to form (and/or enhance the loft of) the at least one raised structure 128. The raised structure 128 may be a variety of shapes and sizes, and in one example, may be a generally spherical shaped structure. The second area 130 may surround a periphery or at least one side of the raised structure 128 to form the pod 160. As shown in FIG. 4 illustrating a cross-sectional view of the knitted component 132, the second area 130 has a height 130*a*, or in other words a thickness, and a width 130*b*, that are much smaller than a height 128*a*, or thickness, and a width 128*b* of the raised structure 128.

The pod 160 is formed by two (or more) knit layers that are at least partially overlapping and co-extensive with each other that form a pocket 159 between them within the pod 160. When exposed to a stimulus (e.g., heat or steam), the second knit layer extends away from the first knit layer to form the raised structure 128 (described in more detail below). The second area 130 that demarcates the pod 160 may also be formed by the two (or more) knit layers (as described in more detail below). An element may be placed within the pocket (e.g., a floating portion of a yarn). The raised structure 128 may be arranged at any suitable location on the article of footwear, such as in the heel area 122, the midfoot area 120, the toe are 124, the medial side 108, the lateral side 106, and/or another location or combination thereof. The raised structure 128 may be advantageous for providing the article of footwear 100 with suitable cushioning, rigidity (e.g., without sacrificing flexibility in certain directions), durability, desirable aesthetic properties, or other properties. Any suitable number of raised structures 128 may be included. In some embodiments, a plurality of raised structures 128 may be included. In one non-limiting example, as shown in FIGS. 1 and 2, a plurality of raised structures 128 may be present. One example of a raised structure is described in U.S. Provisional Patent Application No. 62/702,248, filed on Jul. 23, 2018, which is incorporated by reference herein in its entirety.

At least a portion of the upper 102, and in some embodiments substantially the entirety of the upper 102, may be formed of a knitted component 132, which may be formed, for example, by a weft-knitting process on a flat knitting machine. The knitted component 132 may additionally or alternatively form another element of the article of footwear 100, such as an underfoot portion, for example. As shown in FIGS. 3-5, the knitted component 132 may have a first side 134 that forms an interior surface of the upper 102 (e.g., facing the void 118 of the article of footwear 100) and a second side 136 that forms an exterior surface of the upper 102 (e.g. facing generally opposite the first side 134). The first side 134 and the second side 136 of the knitted component 132 may exhibit different characteristics (e.g., the first side 134 may provide abrasion resistance and comfort while the second side 136 may be relatively rigid and provide desirable aesthetic properties, water resistance, among other advantageous characteristics mentioned herein). The knitted component 132 may be formed as an integral one-piece element during a knitting process, such as a weft knitting process (e.g., with a flat knitting machine or circular knitting machine), a warp knitting process, or any other suitable knitting process. That is, the knitting process on the knitting machine may substantially form the knit structure of the knitted component 132 without the need for significant post-knitting processes or steps. Alternatively, two or more portions of the knitted component 132 may be formed separately as distinct integral one-piece elements and then the respective elements attached.

Forming the upper 102 with the knitted component 132 may provide the upper 102 with advantageous characteristics including, but not limited to, a particular degree of elasticity (for example, as expressed in terms of Young's modulus), breathability, bendability, strength, moisture absorption, weight, abrasion resistance, and/or a combination thereof. These characteristics may be accomplished by selecting a particular single layer or multi-layer knit structure (e.g., a ribbed knit structure, a single jersey knit structure, or a double jersey knit structure), by varying the size and tension of the knit structure, by using one or more yarns formed of a particular material (e.g., a polyester material, a relatively inelastic material, or a relatively elastic material such as spandex), by selecting yarns of a particular size (e.g., denier), and/or a combination thereof. The knitted component 132 may also provide desirable aesthetic characteristics by incorporating yarns having different colors, reflectivity, textures or other visual properties arranged in a particular pattern.

The yarns themselves and/or the knit structure formed by one or more of the yarns of the knitted component 132 may be varied at different locations such that the knitted component 132 has two or more portions with different properties (e.g., a portion forming the throat area 112 of the upper 102 may be relatively elastic while another portion may be relatively inelastic). In some embodiments, the knitted component 132 may incorporate one or more materials with properties that change in response to a stimulus (e.g., the application of steam and/or other forms of heat, moisture, electrical current, magnetic field, or light).

For example, the knitted component 132 may include yarns formed of a thermoplastic polymer material (e.g., polyurethanes, polyamides, polyolefins, and nylons) that transitions from a solid state to a softened or liquid state when subjected to certain temperatures at or above its melting point and then transitions back to the solid state when cooled. The thermoplastic polymer material may provide the ability to heat and then cool a portion of the knitted component 132 to thereby form an area of fused or bonded or continuous material that exhibits certain advantageous properties including a relatively high degree of rigidity, strength, and water resistance, for example.

The knitted component 132 may include a seamless portion extending from the toe area 124, through the midfoot area 120, and to the heel area 122 on at least one of the lateral side 106 and the medial side 108 of the upper 102. In some embodiments, the knitted component 132 may include a first edge (not shown) and a second edge (not shown), which may be terminal ends of the knitted component 132 after the knitting process when the knitted component 132 is removed from the knitting machine. After the knitting process, the knitted component 132 may be folded or otherwise manipulated such that a first edge and the second edge are secured together at a seam (not shown) during formation of the upper 102. The seam may be located on the lateral side 106 of the upper 102, on the medial side 108 of the upper 102, and/or in another location (e.g., at the back of the heel area 122 of the upper 102). Forming the upper 102 such that it is in an appropriate shape for inclusion in an article of footwear 100 may further include lasting the upper 102. An example of a lasting process is described in U.S. patent application Ser. No. 12/848,352, filed Aug. 2, 2010, and issued as U.S. Pat. No. 8,595,878, which is herein incorporated by reference in its entirety.

When forming the knitted component 132, the knitted component 132 may be oriented with respect to a needle bed of the knitting machine such that the toe region 124 is knit first, followed by the midfoot region 120, and then the heel region 122 (or vice versa, with the heel region 122 being knit first and the toe region 124 being knit last). In this embodiment, courses of the knitted component 132 are knit from the medial side 108 to the lateral side 106 (and vice versa, from the lateral side 106 to the medial side 108). In another embodiment, the knitted component 132 may be oriented with respect to the needle bed of the knitting machine such that a first course of the knitted component 132 is knit extending from the heel region 122, through the midfoot region 120 and into the toe region 124 (or vice versa, where the first course is knit extending from the toe region 124, through the midfoot region 120 and to the heel region 122). In this second embodiment, courses of the knitted component 132 are knit from the heel region 122 to the toe region 124 (and vice versa, from the toe region 124 to the heel region 122). In both embodiments, additional courses are formed parallel to a first course of the knitted component 132.

A course of the knitted component 132 may be formed by one pass on the knitting machine or, in the other words, a course may be formed by knitting left to right or right to left across the needle bed of the knitted machine. In another embodiment, a course of the knitted component 132 may be formed by two passes on the knitting machine, or, in other words, a course may be formed by knitting from left to right and then from right to left (or vice versa) across the needle bed of the knitted machine. One skilled in the art would understand how to make the knitted component 132 whether a single pass is referred to as a course or two passes is referred to as a course. Each course may include one or more yarns dispensed from a feeder during each pass.

In some embodiments, each course may include a continuous strand of yarn that extends between the lateral side 106 and the medial side 108 of the upper 102 or between the heel region 122 and the toe region 124. Additionally or alternatively, one or more strands of yarn forming at least a portion of each course may extend less than the full length of the first course. For example, it is contemplated that a strand of yarn may extend from one side of the upper (such as the lateral side 106 or the medial side 108) to the other side of the upper, but may terminate within the course prior to reaching the other side. In one non-limiting example, one strand of yarn may extend from the lateral side 106 towards the medial side 108 when forming a course but terminate before it reaches the medial side 108. The course may continue in an uninterrupted manner towards the medial side 108, but with an additional or alternative strand of a different second yarn picking up where the first yarn terminated. Alternatively, a first strand and a second strand can be combined such that the course is knitted with a combination of the first and second strands of yarn.

Figure 7B:
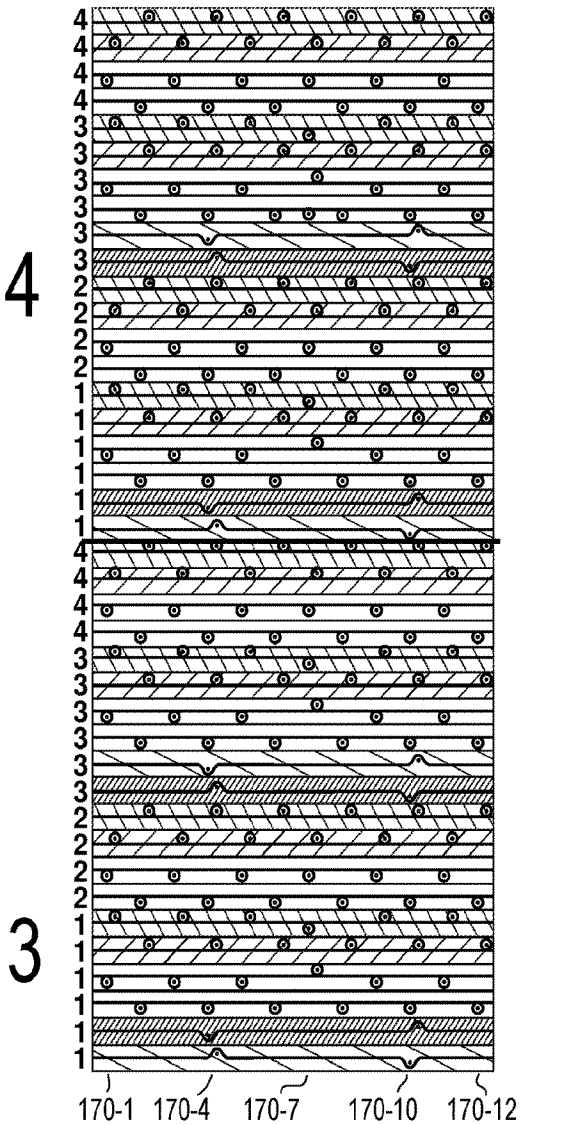
FIGS. 7A-7B are illustrations showing exploded views of the program view of the knitting sequence of FIG. 6.
Figure 7A:
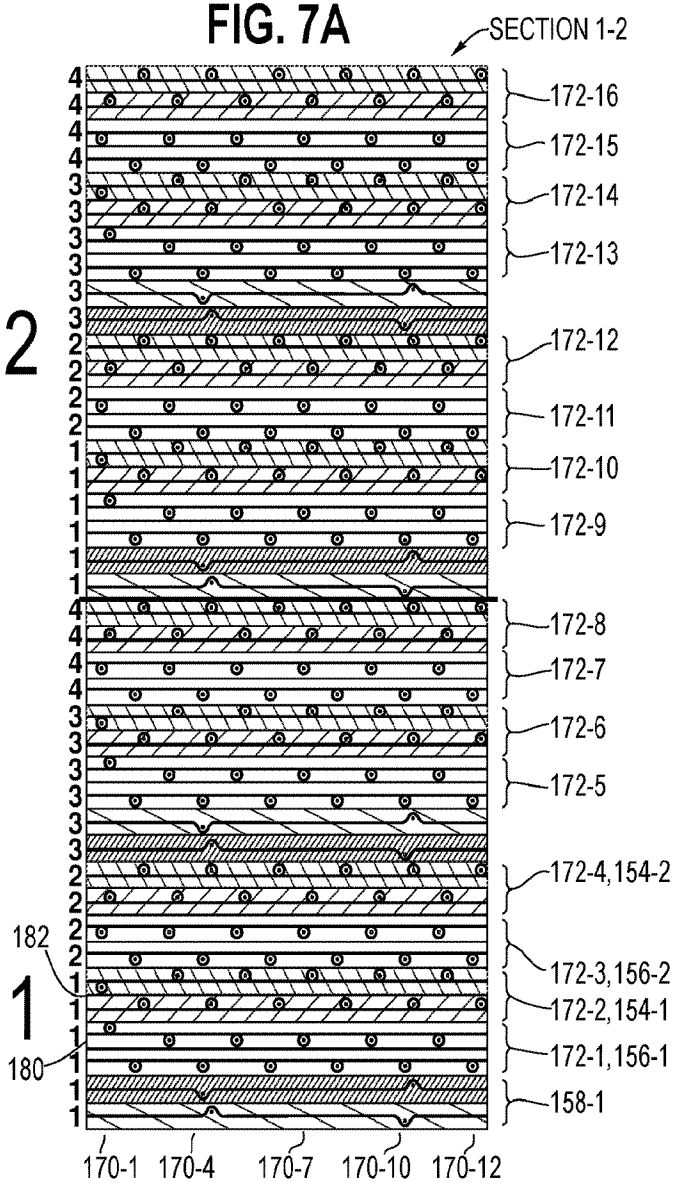

As shown in FIGS. 7A-7B (and as described in further detail below), the courses of the knitted component 132 may at least partially form the pod 160, the raised structure 128, and/or portions of the second areas 130. FIGS. 3-4 show close-up, cross-sectional views of a portion of the knitted component 132. While FIG. 3 shows a partial cross-sectional view of the knitted component 132 before being subjected to a stimulus (including but not limited to steam or heat, for example), FIG. 4 shows a partial cross-sectional view of the knitted component 132 after being subjected to a post-manufacture process or stimulus treatment, including, but not limited to steam 166.

As shown in FIGS. 3 and 4, at least a portion of the upper 102 (such as the pods 160) may have a first layer 154, a second layer 156, and an optional third layer 158 (also referred to as the middle layer). The pod 160 is formed of the first layer 154 and the second layer 156, which are coextensive and/or overlapping with each other and form a pocket 159 there between. The pod 160 is demarcated on at least one side by the second area 130. The third layer 158 is positioned within the pocket 159 of the pod 160 between the first layer 154 and the second layer 156, as shown in FIGS. 3-5. Within the pod 160, the third layer 158 is secured or otherwise connected to a portion of the first layer 154 and to a portion of the second layer 156 (described in more detail below). The second layer 156, and in some embodiments the third layer 158 as well, of the pod 160 forms the raised structure 128 when subjected to a stimulus (e.g. including without limitation heat, steam or temperature), as shown in FIGS. 4 and 5. A shown in FIG. 3, the second layer 156 of the pod 160 may be partially raised before the stimulus is applied. The second layer 156 of the pod 160 will further rise (e.g. move away from the first layer 154) after the stimulus is applied to form the raised structure 128.

In other portions of the upper 102, such as the second area 130, a multi-layer knit structure is not required (but in the depicted embodiment, multiple layers are included). In the second area 130, as shown in FIGS. 3-5, the first layer 154 and the second layer 156 are at least partially coextensive and/or overlapping and, in at least one part, connected to each other, and the third layer 158 floats or is inlaid between the first layer 154 and the second layer 156 (described in more detail below). As described above, and as shown in FIGS. 4-5, the height 130*a*, or thickness, and the width 130*b* of the second area 130 is smaller than the height 128*a*, or thickness, and the width 128*b* of the raised structure 128. Therefore, when the knitted component 132 is subjected to a stimulus, the second area 130 does not form a raised structure 128 due to the dimensions of the second area 130, the configuration of the first layer 154, the second layer 156 and the third layer 158 within the second area 130, the connection of the first layer 154 and the second layer 156 within the second area 130, and the lack of connection of the third layer 158 to the first layer 154 and the second layer 156 within the second area 130.

At least in the pod 160, the first layer 154 and the second layer 156 may both be formed by looped structures of the knitted component 132 such that they are primarily formed on a knitting machine. The third layer 158 is also primarily formed on the knitting machine with the first layer 154 and the second layer 156. However, as described in more detail below, the third layer 158 may generally lack a looped knit structure (i.e., intermeshed loops) at least within the pod 160 and therefore may at least partially float between the first layer 154 and the second layer 156. In some embodiments, the third layer 158 may be secured to at least one of the first layer 154 and the second layer 156 via tuck stitches and/or a loop. For example, in FIGS. 3-5, the third layer 158 is secured to a portion of the first layer 154 at a first location 162*a* within the pocket 159 and a portion of the second layer 156 at a second location 164*a* within the pocket 159 in each of the raised structures 128 by tuck stitches. In each of the second areas 130, the third layer 158 may be formed as an inlaid strand located between opposite surfaces of the knitted component 132, as shown, but alternatively the third layer 158 may be incorporated into the knitted loops of one or more layers of the second areas 130.

When the knitted component 132 is included in the upper 102, the second layer 156 may form a portion of the exterior surface of the upper 102 and the first layer 154 may form a portion of the interior surface of the upper 102. In one embodiment, as shown in FIGS. 3-5, the second layer 156 forms a portion of the exterior surface of the upper 102 at each of the raised structures 128 and forms a portion of the interior surface of the upper 120 at each of the second areas 130. The first layer 154 forms a portion of the interior surface of the upper 102 at each of the raised structures 128 and forms a portion of the exterior surface of the upper 120 at each of the second areas 130.

Each raised structure 128 may be separated on at least one side by a second area 130. As shown in FIGS. 1-2, the raised structures 128 may be parallel or generally parallel to each other along "a first direction" A (where direction A is the "course-wise" direction," or the direction substantially parallel to the longitudinal direction of courses extending through the knitted component 132). In the depicted embodiment, direction A is illustrated as a medial to lateral direction, generally along an y-axis as shown in FIG. 2, but the courses could alternatively extend a different direction through the knitted component 132. The raised structure 128 may also (or alternatively) be parallel or generally parallel to each other along "a second direction" B, which may be a "wale-wise" direction that is perpendicular to direction A (which is illustrated as a heel to toe direction, generally along an x-axis as shown in FIG. 2). In an alternate embodiment, as shown in FIGS. 5-7B, the raised structures 128 may be offset from each other along either the first direction A or the second direction B and generally parallel to each other along the other of the first and second directions A, B. As shown in the cross-sectional side view of FIG. 5, the raised structures 128 are parallel or generally parallel to each other along the first direction A and offset from each other along the second direction B. In an alternate embodiment, the raised structures 128 may be parallel or generally parallel to each other along the second direction B and offset from each other along the first direction A. The first direction A may be approximately parallel to the needle bed when the knitted component 132 is being formed on a knitting machine. In an alternate embodiment, the second direction B may be approximately parallel to the needle bed when the knitted component 132 is being formed on a knitting machine.

A variety of processes are contemplated for creating the raised structure 128, and these processes may occur during or after the knitting process for forming the knitted component 132. For example, the upper 102 may be knit on a knitting machine having a front bed and a back bed. In one example, a yarn knit on the back bed may ultimately form the first layer 154 of the knitted component 132, and a yarn knit on the front bed may ultimately form the second layer 156 of the knitted component 132. A yarn may float through the needles of the knitted component 132 to form the third layer 158 and tuck to one of the needles on the back bed to connect the third layer 158 with the first layer 154 and tuck to one of the needles on the front bed to connect the third layer 158 with the second layer 156.

One or more yarns may be used when knitting the knitted component 132. In one non-limiting example, a first yarn may be used to form the first knit layer 154 of the knitted component 132 (at least in the pod 160), which forms at least a portion of the first side 134 of the knitted component 132 that forms an interior surface of the upper 102. The first yarn may include, for example a relatively elastic yarn. One or more ends of the first yarn may be used, such as one end or two or more ends. Preferably, in this example, one end of the first yarn may be used. In one non-limiting example, the first yarn may be an "EO4"-type yarn supplied by Unifi, Inc. of Greensboro, N.C., which preferably has a relatively high elasticity compared to other yarns that may be used to form the knitted component 132. The first yarn may comprise a spandex core (i.e. Lycra) wrapped with polyester. It may have a denier range of approximately 800 D to approximately 1050 D, a tensile strength of >0.75 kgf (kilogram-force) and an elongation of 180%-250%. Denier is a unit of measure for linear density of fiber and is measured in gram per 9,000 meters. In some embodiments, such as when it is desirable for the first yarn to reduce in size during the manufacturing process, the shrinkage rate of the first yarn, also referred to as the first shrinkage rate, may be higher relative to other yarns used to form the knitted component 132 when subjected to heat (or another stimulus). In other words, for example, when subjected to heat (e.g., via steam), the first yarn may shrink more, and/or at have a higher shrinkage rate, than the other yarns used to form the knitted component 132. In one example, the shrinkage rate of the EO4 from Unifi, Inc. was tested using a standard jacquard square program, and the results are provided in the table below.

| Yarn Name | Before Steaming X | Before Steaming Y | After Steaming X | After Steaming Y | Shrink % X | Shrink % Y |
|---|---|---|---|---|---|---|
| EO4 | 402 mm | 330 mm | 359 mm | 295 mm | 11% | 11% |

A second yarn may be used to form the second knit layer 156 of the knitted component 132, which forms at least a portion of the second side 136 of the knitted component 132 that forms the exterior surface of the upper 102. The second yarn may be the same as the first yarn or it may be different. In one example, the second yarn used to form at least a portion of the second side 136 of the knitted component 132 (which forms at least a portion of the exterior surface of the upper 102, at least in the pod 160) is a yarn that has different properties relative to the first yarn. The second yarn may include a combination of materials or strands. One or more ends of the second yarn may be used, such as one end, two ends or more than two ends. For example, the second yarn may include a combination of one end of "monofilament"-type yarn and one end of a yarn formed of a thermoplastic polymer material, sometimes referred to as a "fusible yarn."

The monofilament yarn of the second yarn may be supplied from Formosa Ting Sho of Taiwan and may be referred to as monofilament 0.125 mm nylon, which may have a relatively low elasticity compared to the first yarn that may be used to form the knitted component 132. The monofilament yarn of the second yarn may expand or have low to minimal shrinkage when subjected to a stimulus (e.g. temperature, heat or steam). The monofilament yarn may have a denier range of approximately 125 D to approximately 150 D, a tensile strength of about 0.8-1.2 kgf (kilogram-force) and an elongation of 16%-25%. As described above, denier is a unit of measure for linear density of fiber and is measured in gram per 9,000 meters.

The fusible yarn of the second yarn may be manufactured by EMS-Griltech of Domat, Switzerland, which may also have a relatively low elasticity compared to the other yarns that may be used to form the knitted component 132. The fusible yarn is a low-melt yarn that provides stiffness, structure and strength to the knitted component 132 after being subjected to a stimulus (e.g. temperature, heat, or seam). The fusible yarn has a melting temperature of 65 degrees Celsius, may have a denier (explained above) range of approximately 140 D to approximately 170 D, a tensile strength of >0.375 (kilogram-force) and an elongation of 53%-74%. Varying colors of the fusible yarn may be used. In one example, the fusible yarn may have a translucent color such that when the stimulus (e.g. temperature, heat, or steam) is applied to the second yarn, the fusible yarn melts, which causes the second yarn to become even more translucent such that the color of the yarn of the third layer 158 is visible from the exterior surface of the upper 102. The fusible yarn of the second yarn may expand or have low to minimal shrinkage when subjected to a stimulus (e.g. temperature, heat or steam).

The shrinkage rate of the second yarn when exposed to steam (or another stimulus), also referred to as the second shrinkage rate, may be lower relative to the first shrinkage rate of the first yarn to form the knitted component 132. In other words, when subjected to a similar amount of heat, (e.g., such as via temperature, heat or steam), the second yarn may shrink much less if at all, have a lower shrinkage rate than the first shrinkage rate of the first yarn used to form the knitted component 132, and/or expand. The combination of materials, such as the monofilament yarn and the fusible yarn that together form the second yarn, may be achieved by twisting, winding, braiding, and or wrapping on about the other and the like, and/or the yarns may be a core/sheath configuration, and/or the yarns may be tacked along their length at a plurality of points. In one example, the shrinkage rate of a 0.125 mm monofilament yarn, supplied from Hi-Tech of South Korea, and the fusible yarn from EMS-Griltech were tested using a standard jacquard square program, and the results are provided in the table below.

| Yarn Name | Before Steaming X | Before Steaming Y | After Steaming X | After Steaming Y | Shrink % X | Shrink % Y |
|---|---|---|---|---|---|---|
| Monofilament | 457 mm | 400 mm | 451 mm | 375 mm | 1% | 6% |
| Fusible | 430 mm | 373 mm | 438 mm | 360 mm | −2% | 3% |

In addition to the first and second yarn used to form the knitted component 132, a third yarn may be used to form the third layer 158 of the knitted component 132. The third yarn may be the same as the first yarn and/or the second yarn, or it may be different. In one example, the third yarn used to form at least a portion of the knitted component 132 comprises a yarn that is different than the first yarn and the second yarn. In one example, the third yarn is a relatively less elastic than the first yarn (EO4) and may have the same elasticity, less elasticity or more elasticity than the second yarn (which may be monofilament and fusible, as described above). The third yarn may be a combination of materials or strands. One or more ends of the third yarn may be used, such as one end, two ends or more than two ends.

For example, the third yarn may include a combination of three ends of "monofilament"-type yarn and one end of a "high tenacity"-type yarn. The monofilament yarn may include the same properties as the monofilament yarn used in the second yarn described above. Like the monofilament of the second yarn, the monofilament yarn of the third yarn may expand or have low to minimal shrinkage when subjected to a stimulus (e.g. temperature, heat or steam). The high tenacity yarn may be supplied by Far Eastern New Century of Taipei, Taiwan. The high tenacity yarn is a polyester yarn that may include multiple filaments of yarn and impart various aesthetic and color properties to the knitted component 132. The high tenacity yarn has a melting point of about 210 degrees Celsius. The shrinkage rate of the third yarn (when subjected to steam or another stimulus), also referred to as the third shrinkage rate, may be lower relative to the first shrinkage rate of the first yarn and greater than, less than or equal relative to the second shrinkage rate of the second yarn used to form the knitted component 132 when subjected to heat or another stimulus. In other words, when subjected to a similar amount of heat (e.g., such as via temperature, heat or steam), the third yarn may shrink much less if at all, have a lower shrinkage rate than the first shrinkage rate of the first yarn, and/or expand. Also, the third yarn may shrink relatively more than, less than or the same as the second yarn. In one example, the combination of materials, such as the monofilament yarn and the high tenacity yarn that together form the third yarn may be achieved by coexisting in parallel. In other embodiments, the combination of materials may be achieved by twisting, winding, braiding, and or wrapping on about the other and the like, and/or the yarns may be a core/sheath configuration, and/or the yarns may be tacked along their length at a plurality of points. In one example, the shrinkage rate of a 0.125 mm monofilament yarn, supplied from Hi-Tech of South Korea, and the high tenacity yarn from Far Eastern New Century were tested using a standard jacquard square program, and the results are provided in the table below.

| Yarn Name | Before Steaming X | Before Steaming Y | After Steaming X | After Steaming Y | Shrink % X | Shrink % Y |
|---|---|---|---|---|---|---|
| Monofilament | 457 mm | 400 mm | 451 mm | 375 mm | 1% | 6% |
| High tenacity | 318 mm | 265 mm | 310 mm | 257 mm | 3% | 3% |

During or after the knitting process, a stimulus, such as heat, may be applied to at least a portion of, or to the entirety of the upper 102. This heat may be in the form of steam, such as by a steam gun or other steam-providing device, for example. One or more effects may result from the exposure of the knitted component 132 to steam 166.

In one example, the steam 166 may cause one or more of the yarns used to form the knitted component 132 to shrink at different relative rates, thus forming the raised structure 128, as shown in FIG. 4. For example, the steam 166 may cause the first yarn (e.g. the EO4 yarn) to shrink at a higher degree and/or rate than the second and third yarns used to form the knitted component 132. In one example, the second yarn (e.g. the monofilament and fusible yarns) may also shrink in response to the steam 166 stimulus, but less so than the first yarn. The second yarn has relatively little or insignificant shrinkage in response to the stimulus, and the second yarn may also expand when subjected to the stimulus. The third yarn (e.g. the monofilament and high tenacity yarns) also has relatively little or insignificant shrinkage in response to the steam 166 stimulus, and the third yarn may also expand when subjected to the stimulus. The shrinkage rates and potential expansions of the first, second and third yarns may result in an overall shrinkage rate for the knitted component 132. In one example, the overall shrinkage rate of the knitted component 132, after a stimulus was applied, included an average shrinkage rate of 10% along the length (x: toe to heel) of the knitted component 132 and an average shrinkage rate of 14.25% along the width (y: posterior to anterior).

Figure 6:
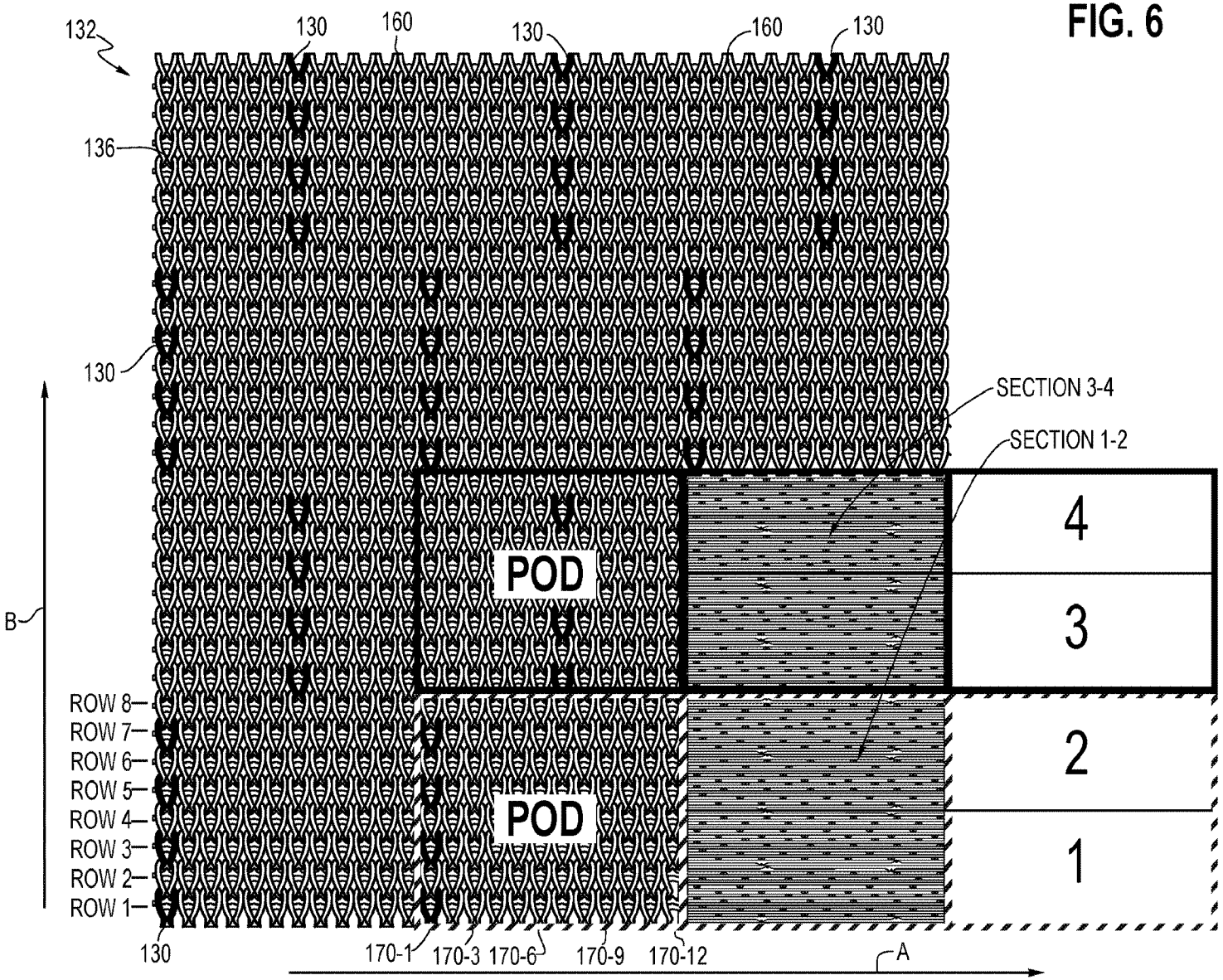
FIG. 6 is an illustration showing a top view of a knitted component prior to the stimulus step and a corresponding program view of a knitting sequence for forming the knitted component in accordance with certain aspects of the present disclosure.

As shown in FIGS. 3-5, the first yarn, which forms the first knit layer 154, may be used to form at least a portion of the first side 134 of the knitted component 132, and therefore form an interior surface of an upper 102 (e.g., facing a void) at the pods 160 (and beneath the raised structures 128) of the upper 102. The first yarn may also be used to form at least a portion of the second side 136 of the knitted component 132, thus forming an exterior surface of the upper 102 at the second areas 130. The second yarn, which forms the second knit layer 156, may be used to form at least a portion of the second side 136 of the knitted component 132, which forms the exterior surface of the upper 102 at the pods 160 or the raised structures 128 of the upper 102. The second yarn may also be used to form at least a portion of the first side 134 of the knitted component 132 that forms an interior surface of the upper 102 at the second areas 130. Prior to exposing the knitted component 132 to a stimulus (see FIG. 3), the second side 136 may be generally flat, overlapping and generally coextensive to the first side 134. Alternatively, prior to exposing the knitted component 132 to a stimulus, the raised structure 128 of the pod 160 may be partially visible as shown in FIG. 3 (e.g., due to using more courses to form the second side 136 than the first side 134 during knitting), but not as pronounced and/or defined as shown in FIGS. 4-5 which illustrates one example of the knitted component 132 after exposure to a stimulus. When exposed to a stimulus, such as steam 166, the first yarn of the first knit layer 154 shrinks, while the second yarn on the second knit layer 156 of the knitted component 132 and the third yarn of the third layer 158 each have relatively little or insignificant shrinkage. In one example, the second yarn of the second knit layer 156 and the third yarn of the third layer 158 may expand. The shrinkage of the first yarn causes the second yarn to buckle or bulge outward as shown in FIGS. 5-6 and by the arrows in FIG. 4 to form a raised structure 128 that extends outwardly and away from the first side 134 of the knitted component 132. When the second yarn and the third yarn expand, the expansion of the second yarn and the third yarn may also enhance the buckling/bulging of the second side 134. In other words, the relative difference in shrinkage rates and also expansion among the different yarns used to form the knitted component 132 upon exposure to a stimulus results in the formation or enhancement of the raised structure 128.

As shown in FIGS. 3-5, more than one third yarn may form the third layer 158 of the knitted component 132. In one example, in the side cross-sectional views of FIGS. 3-5, there are two of the third yarns that form the third layer 158 including the first portion **158*a* of the third yarn and the second portion 158*b* of the third yarn, which may cross one another and form an "X" configuration within the pods 160 or the raised structures 128 when viewed from a side cross-sectional view. In one example, the first portion 158*a* and the second portion 158*b* of the third yarn have the same properties, or in another example, the first portion 158*a* and the second portion 158*b* of the third yarn may have the same or similar properties except for one or more properties, such as color. As shown in FIGS. 3-5, the first portion 158*a* and the second portion 158*b* of the third yarn float through the knitted component 132 within the second areas 130 and, in this embodiment, are therefore unsecured from the first layer 154 and the second layer 156 within the second areas 130, but alternatively the third yarn 158 may at least partially form intermeshed loops within the second areas 130**.

Within the pods 160 or the raised structures 128, the third yarn may be secured to the first layer 154 and the second layer 156 via tuck stitches and/or a loop. The first portion **158*a* of the third yarn may be secured to a portion of the second layer 156 at a second location 164*a* via a tuck stitch and/or a loop, and the second portion 158*b* of the third yarn may be secured to a portion of the first layer 154 at a first location 162*a* via a tuck stitch and/or a loop. The first portion 158*a* and the second portion 158*b* of the third yarn then cross each other within the pocket of the pod 160. The first portion 158*a* of the third yarn may then be secured to a portion of the first layer 154 at a third location 162*b* via a tuck stitch and/or a loop, and the second portion 158*b* of the third yarn may be secured to a portion of the second layer 156 at a fourth location 164*b* via a tuck stitch and/or a loop. The securing of the third yarn via tuck stitches and/or loops to the first layer 154 and the second layer 156 secures the placement and positioning of the third layer 158 within the pods 160**.

As described above, in one example, the second yarn may be translucent or transparent (at least after a stimulus, such as heat-processing, is applied to the knitted component 132) and the third yarn may have a color that is visible through the raised structure 128 on the exterior surface of the upper 102. The positioning of the third yarn may vary within the raised structure 128 such that the color of the third yarn is visible at differing viewpoints on the exterior surface of the upper 102. For example, the first portion **158*a* of the third yarn may have a color different than the second portion 158*b* of the third yarn such that the color of the first portion 158*a* of the third yarn is visible through the exterior surface of the upper 102 at one viewpoint or position and the color of the second portion 158***b* of the third yarn is visible through the exterior surface of the upper 102 at a different viewpoint or position. Thus, with selective positioning of the third yarn, including where the third yarn is secured to the second layer 156 within the pod 160 and the raised structure 128, different colors may be visible through the exterior surface of the upper 102.

Turning now to FIGS. 6 and 7A-7B, a knit program used to form a knitted component 132 comprising one or more pods 160 to form the raised structures 128 and second areas 130 will be described. First, FIG. 6 shows an annotated top view of the knitted component 132 reflecting the second side 136 of the knitted component 132 (which may form the exterior surface of the upper 102 when the knitted component 132 is incorporated into article of footwear 100). The section of the knitted component 132 outlined in pink (e.g., dashed line in black and white drawing figures) with sections "1" and "2" adjacent to it corresponds with an exploded view of a knit program shown in FIG. 7A. This section will be referred to herein as SECTION1-2. The section of the knitted component 132 outlined in blue (solid black line in black and white drawing figures) with sections "3" and "4" adjacent it corresponds with an exploded view of a knit program shown in FIG. 7B. This section will be referred to herein as SECTION3-4. SECTION1-2 and SECTION3-4 together reflect an offset configuration of the pods 160 that form the raised structures 128 as described previously and as shown in FIG. 5. In addition to a pod 160 as described herein, SECTION1-2 also reflects a second area 130. SECTION3-4 reflects two halves of adjacent pods 160 with a second area 130 between the two halves of adjacent pods 160. In other words, in comparison to FIG. 3, SECTION3-4 shows the second area 130 in the middle of FIG. 3 and half of the pod 160 to the left of the second area 130 and half of the pod 160 to the right of the second area 130.

In FIG. 6, the light green yarn (shown as light grey in black and white figures) reflects the yarn of the second layer 156 that forms a portion of the second side 136 of the knitted component 132 or the exterior surface of the upper 102. The orange yarn (shown as black in the black and white figures) reflects the yarn of the first layer 154, which at the second areas 130 of the knitted component 132 forms a portion of the second side 136 of the knitted component 132 or the exterior surface of the upper 102.

Turning to SECTION1-2 shown in FIG. 6 and FIG. 7A, the knitted component 132 is formed of a plurality of courses and wales. In weft knitting, the wales are perpendicular to the courses of the yarn. The wales of SECTION1-2 and SECTION3-4 within knitted component 132 are numbered as 170-*x* with "x" reflecting the respective wale, specifically wales 1 through 12. In this example, the number of wales is the same as the number of needles within a needle bed of the knitting machine. The needles are represented as dots in FIGS. 7A-7B. As shown in FIG. 7A, the courses of SECTION1-2 within knitted component 132 are numbered as "172-*x*" with "x" reflecting the respective course, specifically courses 1 through 16. In this embodiment, to create one course, e.g. 172-1, two passes on the knitting machine are completed, e.g. from left to right and then from right to left along the needle bed of the knitting machine. As described above, in alternate embodiments, one course may be created by one pass on the knitted machine (e.g. from left to right or right to left). In the example shown in FIG. 6 and FIG. 7A, SECTION1-2 is formed of 16 courses and 12 wales. The 16 courses create 8 rows of the first side 134 of the knitted component 132 and 8 rows of the second layer side 136 of the knitted component 132. The 8 rows of the second side 136 of the knitted component 132 are shown in FIG. 6 and labeled as "Row x" with x reflecting the respective row of Rows 1-8. In alternate embodiments, the number of courses can be decreased to decrease the size of the pod 160 or can be increased to increase the size of the pod 160. In other words, when the pod 160 forms a raised structure 128 of a substantially spherical shape with a first diameter extending along the first direction A and a second diameter extending along the second direction B, the number of courses can be decreased to decrease the second diameter of the raised structure 128 or can be increased to increase the second diameter of the raised structure 128. Also, in this example, the number of wales for each pod 160 may be decreased to decrease the first diameter of the raised structure 128 or can be increased to increase the first diameter of the raised structure 128.

In FIG. 7A, a first course 172-1 of the knitted component 132 is formed to create a first part of the second layer 156 of the knitted component 132 and a second course 172-2 of the knitted component 132 is formed to create a first part of the first layer 154-1 of the knitted component 132. The first part of the second layer 156 is labeled as 156-1 in FIG. 7A, and the first part of the first layer 154 is labeled as 154-1 in FIG. 7A. In the first pass of the first course 172-1, the second layer 156-1 is knit using every other needle on the front needle bed of the knitting machine. In the second pass of the first course 172-1, the second layer 156-1 is knit using every other needle (and specifically, the needles skipped on the first pass of the first course 172-1) on the front needle bed of the knitting machine except for the first needle shown in the first wale 170-1, where the second layer 156-1 is knit on the first needle of the back needle bed of the knitting machine (e.g., by knitting a loop 180 of the first course 172-1 on the back needle bed, thus anchoring the first layer 154-1 and the second layer 156-1). More than two passes of the first course 172-1 may be utilized (e.g., such that more knitted material is formed on the second side 136 of the knitted component 132 to enhance the loft of the raised structures 128).

In the first pass of the second course 172-2, the first layer 154-1 is knit using every other needle on the back needle bed of the knitting machine. In the second pass of the second course 172-2, the first layer 154-1 is knit using every other needle (and specifically, the needles skipped on the first pass of the second course 172-2) on the back needle bed of the knitting machine except for the first needle shown in the first wale 170-1 where the first layer 154-1 is knit on the first needle of the front needle bed of the knitted machine (e.g., by knitting a loop 182 of the second course 172-2 on the front needle at a location corresponding to the loop 180). Anchoring the first layer 154-1 and the second layer 156-1 formed on the front and back needle beds may create the above-described second area 130 separating respective pods.

When the first layer 154-1 is knit on the front needle bed and the second layer 156-1 is knit on the back needle bed, part of one of the second areas 130 is formed such that the first layer 154-1 forms a portion of the second side 136 of the knitted component 132 (and exterior surface of the upper 102) and the second layer 156-1 forms a portion of the first side 134 of the knitted component 132 (and the interior surface of the upper 102). In part of the second areas 130, the first layer 154-1 and the second layer 156-1 are therefore secured to each other, and the third layer 158 is floating between the first layer 154 and the second layer 156 (described below).

As shown in FIG. 7A, to form the third layer 158 that is positioned between the first layer 154-1 and the second layer 156-1, two passes on the knitting machine are also completed (e.g. from left to right and right to left). This part of the third layer 158 is labeled as 158-1 in FIG. 7A. In the first pass, the yarn of the third layer 158-1 floats through the first three needles and then on the fourth needle, tucks to the back needle bed to secure the third layer 158-1 to the first layer 154-1 of the knitted component 132 at the first location 162*a*. The yarn of the third layer 158-1 then floats through the fifth through ninth needles and then on the tenth needle, tucks to the front needle bed to secure the third layer 158-1 to the second layer 156-1 at the second location 164*a*. The yarn of the third layer 158-1 then floats through the eleventh through twelfth needles to complete the first pass. On the second pass, the yarn of the third layer 158-1 again floats through the twelfth through eleventh needles and then on the tenth needle, tucks to the back needle bed to secure the third layer 158-1 to the first layer 154-1 at the third location 162*b*. The yarn of the third layer 158-1 then floats through the ninth through fifth needles, and then on the fourth needle, tucks to the front needle bed to secure the third layer 158-1 to the second layer 156-1 of the knitted component 132 at the fourth location 164*b*. The yarn of the third layer 158-1 then floats through the third through first needles to complete the second pass. The two passes creates the "X"-configuration of the third layer 158-1, as shown in FIGS. 3-5, within the pod 160. In alternate embodiments, the positioning of where the yarn of the third layer 158-1 is secured to either the first layer 154-1 or the second layer 156-1 may vary.

After the first course 172-1 and the second course 172-2 are knitted and the third layer 158-1 is floated through and secured to the first layer 156-1 and the second layer 154-1 via tuck stitches, the third course 172-3 of the knitted component 132 is formed to create a second part of the second layer 156 of the knitted component 132 and a fourth course 172-4 of the knitted component 132 is formed to create second part of the first layer 154 of the knitted component 132. The second part of the second layer 156 is labeled as 156-2 in FIG. 7A, and the second part of the first layer is labeled as 154-2 in FIG. 7A. In the first pass of the third course 172-3, the second layer 156-2 is knit using every other needle on the front needle bed of the knitting machine. In the second pass of the third course 172-3, the second layer 156-2 is knit using every other needle (and specifically, the needles skipped on the first pass of the third course 172-3). As compared to the first part of the second layer 156-1 knit in the first course 172-1, the second part of the second layer 156-2 knit in the third course 172-3 is knit solely on the front needle bed of the knitting machine.

In the first pass of the fourth course 172-4, the first layer 154-2 is knit using every other needle on the back needle bed of the knitting machine. In the second pass of the fourth course 172-4, the first layer 154-2 is knit using every other needle (and specifically, the needles skipped on the first pass of the fourth course 172-4) on the back needle bed of the knitting machine. As compared to the first part of the first layer 154-1 knit in the second course 172-2, the second part of the first layer 154-2 knit in the fourth course 172-4 is knit solely on the back needle bed of the knitting machine. In this example, the second part of the first layer 154-2 and the second part of the second layer 156-2 are not secured to one another at the first needle of the knitting machine. Also, in this example, the third layer 158 is not secured to the second part of the first layer 154-2 or the second part of the second layer 156-2. In other embodiments, the second part of the first layer 154-2 and the second part of the second layer 156-2 may be secured to one another. Also, in other embodiments, the third layer 158 may be secured to the second part of the first layer 154-2 and the second part of the second layer 156-2.

As shown in FIG. 7A, the pattern of knitting the first course 172-1, the second course 172-2, the third course 172-3, and the fourth course 172-4 and floating and securing the third layer 158-1 to the first layer 154-1 and the second layer 156-2 via tuck stitches is then repeated in the fifth through eight courses (172-5, 172-6, 172-7, 172-8), the ninth through twelfth courses (172-9, 172-10, 172-11, 172-12), and the thirteenth through sixteenth courses (172-13, 172-14, 172-15, and 16).

The first course 172-1 and the second course 172-2 each create a portion of the first row or "Row-1" of the first row of the second side 136 of the knitted component 132, as shown in FIG. 6, and a portion of the first side 134 of the knitted component 132. The third course 172-3 creates the second row or "Row-2" of the second side 136 of the knitted component 132, as shown in FIG. 6, and the fourth course 172-4 creates the second row of the first side 134 of the knitted component 132. As discussed above, the knitting pattern is repeated such that sixteen courses are formed, which form 8 rows on the first side 134 of the knitted component 132 and 8 rows on the second side 136 of the knitted component 132, as shown in FIG. 6. Also, as discussed above, in alternate embodiments, the number of courses, and accordingly the number of rows, can be decreased to decrease the size of the pod 160 (and therefore the raised structure 128) or increased to increase the size of the pod 160 (and therefore the raised structure 128).

In FIGS. 7A-7B, the light green yarn (shown as white courses in the black and white figures) reflects the yarn of the second layer 156 that forms a portion of the second side 136 of the knitted component 132 or the exterior surface of the upper 102 at the pods 160 and forms a portion of the first side 134 of the knitted component 132 or the interior surface of the upper 102 at the second areas 130. The orange yarn (shown as closely-spaced left-leaning hash lines in the black and white figures) and blue yarn (shown as right-leaning hash lines in the black and white figures) reflect the yarn of the first layer 154, which, at the second areas 130 of the knitted component 132, form a portion of the second side 136 of the knitted component 132 or the exterior surface of the upper 102. At the pods 160 of the knitted component 132, the orange (left-leaning hashed lines) and blue yarns (right-leaning hashed lines) form a portion of the first side 134 of the knitted component 132 or the interior surface of the upper 102. The dark green (shown as widely-spaced left-leaning hashed lines in the black and white figures) and red yarns (shown as solid dark gray in the black and white figures, adjacent to the dark green (e.g. widely-spaced left-leaning hashed lines)) reflect the yarn of the third layer 158 that are positioned between the first layer 154 and the second layer 156 of the knitted component 132.

As described above, SECTION1-2 reflects a second area 130 and a pod 160, which together form a section of the knitted component 132. As shown in FIGS. 6 and 7B, SECTION3-4 forms a portion of the subsequent rows of the knitted component 132. However, as shown in FIG. 6, the orange yarn (shown as closely-spaced, left-leaning hash lines in the black and white figures), which reflects a second area 130 where the first layer 154 is knit on the front needle bed and the second layer 157 is knit on the back needle, is positioned in approximately the center of SECTION3-4. This configuration reflects the offset configuration of the pods 160 (forming the raised structures 128), as shown in FIG. 5. Accordingly, the knitting sequence for the POD3-4 section is different from SECTION1-2 in two ways. First, the first layer 154 switches from knitting on the back needle bed to the front needle bed at the seventh needle, shown at the seventh wale 170-7 in FIG. 7B, rather than at the first needle, shown at the first wale 170-1, in FIG. 7A for SECTION1-2. Second, the second layer 156 switches from knitting on the front needle bed to the back needle bed at the seventh needle, shown at the seventh wale 170-7, rather than at the first needle, shown at the first wale 170-1 in FIG. 7A for SECTION1-2. As described previously, this knitting sequence creates a second area 130 such that the second area is formed in approximately the center of SECTION3-4 rather than at the beginning of SECTION1-2. Other than the aforementioned differences, the knitting sequence and features used to describe SECTION1-2 also apply to SECTION3-4.

In the example shown in FIG. 6, a second area 130 demarcates a pod 160 along the left side of the pod 160 and the right side of the pod 160 or, in other words, along the wale-side direction or the second direction B of the knitted component 132. A second area 130 does not demarcate the entirety of the top side and the bottom side of the pod 160, or along the course-wise direction or the first direction A of the knitted component 132. Rather, a second area 130 forms a securement-type point along the top side and the bottom side of the pod 160. In alternate embodiments, a second area 130 may also extend along the entirety of the top side and/or the bottom side of the pod 160, or along the course-wise direction of the first direction A of the knitted component 132, such that the pod 160 is surrounded by a second area 130 on each of the sides of the pod 160.

The knit sequence of FIGS. 7A-7B may be repeated, as necessary, to form a knitted component with a suitable size. Further, it is noted that the sequence(s) may be varied to incorporate different features by changing certain knit structures, by varying yarn types, by increasing or decreasing the number of courses at each step, or by any other suitable adjustment to the knitting process or materials used. Further, other sequences may be used before, after, or between the sequences of FIGS. 7A-7B.

While the embodiments of the raised structure 128 and other features are described generally herein with reference to an upper 102 for an article of footwear, those features could additionally or alternatively be incorporated into another type of article. For example, knitted raised structures 128 may be included in articles of apparel (e.g., shirts, pants, socks, footwear, jackets and other outerwear, briefs and other undergarments, hats and other headwear), containers (e.g., backpacks, bags), and upholstery for furniture (e.g., chairs, couches, car seats).

In the present disclosure, the ranges given either in absolute terms or in approximate terms are intended to encompass both, and any definitions used herein are intended to be clarifying and not limiting. Notwithstanding that the numerical ranges and parameters setting forth the broad scope of the present embodiments are approximations, the numerical values set forth in the specific examples are reported as precisely as possible. Any numerical value, however, inherently contains certain errors necessarily resulting from the standard deviation found in their respective testing measurements. Moreover, all ranges disclosed herein are to be understood to encompass any and all subranges (including all fractional and whole values) subsumed therein.

Furthermore, the present disclosure encompasses any and all possible combinations of some or all of the various aspects described herein. It should also be understood that various changes and modifications to the aspects described herein will be apparent to those skilled in the art. Such changes and modifications can be made without departing from the spirit and scope of the present disclosure and without diminishing its intended advantages. It is therefore intended that such changes and modifications be covered by the appended claims.

We claim:

1. A knitted component comprising:

a first knit layer and a second knit layer that are at least partially coextensive with each other;

a pocket formed between the first knit layer and the second knit layer; and a yarn at least partially positioned within the pocket between the first knit layer and the second knit layer, the yarn comprising a first strand and a second strand that has at least one different property than the first strand, wherein the first strand of the yarn is secured to the second knit layer at a first location within the pocket and is secured to the first knit layer at a second location within the pocket, wherein the second strand of the yarn is secured to the first knit layer at a third location within the pocket and is secured to the second knit layer at a fourth location within the pocket, and wherein the first strand and the second strand of the yarn form an x-shaped configuration within the pocket.

2. The knitted component of claim 1, wherein the first strand of the yarn and the second strand of the yarn are different colors.

3. The knitted component of claim 1, wherein the first strand of the yarn and the second strand of the yarn have different material compositions.

4. The knitted component of claim 1, wherein the first strand of the yarn and the second strand of the yarn are secured to the first knit layer and the second knit layer within the pocket via tuck stitches.

5. The knitted component of claim 1, wherein the second knit layer forms a raised structure by extending away from the first knit layer when the knitted component is subjected to a stimulus.

6. The knitted component of claim 1, wherein the first knit layer and the second knit layer are secured to each other at a second area adjacent to the pocket.

7. A knitted component comprising:

a first knit layer comprising a first yarn having a first shrinkage rate when subjected to a stimulus;

a second knit layer at least partially coextensive with the first knit layer, the second knit layer comprising a second yarn having a second shrinkage rate when subjected to the stimulus, the second shrinkage rate being less than the first shrinkage rate; and a third yarn at least partially positioned within a pocket formed between the first knit layer and the second knit layer, the third yarn comprising a first strand and a second strand that is separated from the first strand in at least part of the pocket, the second strand of the third yarn having a different property than the first strand;

wherein the third yarn secured to the first knit layer at a first location and a second location within the pocket and to the second knit layer at a third location and a fourth location within the pocket such that the third yarn forms an x-shaped configuration within the pocket.

8. The knitted component of claim 7, wherein the first strand of the third yarn and the second strand of the third yarn are different colors.

9. The knitted component of claim 7, wherein the first strand of the third yarn and the second strand of the third yarn have different material compositions.

10. The knitted component of claim 7, wherein the second knit layer forms a raised structure by extending away from the first knit layer when the knitted component is subjected to the stimulus.

11. The knitted component of claim 10, wherein the third yarn is visible through the second knit layer at the raised structure of the knitted component.

12. The knitted component of claim 10, wherein the raised structure forms a spherical shape.

13. The knitted component of claim 7, wherein the first knit layer and the second knit layer are secured to each other at a second area adjacent to the pocket.

14. The knitted component of claim 7, wherein the third yarn is secured to the first knit layer and the second knit layer within the pocket by tuck stitches.

15. A knitted component comprising:

a plurality of raised structures each formed by a first knit layer and a second knit layer that are at least partially coextensive with each other, each raised structure including a pocket where the second knit layer extends away from the first knit layer, a yarn at least partially positioned within the pocket of each raised structure, the yarn comprising a first strand and a second strand that has at least one different property than the first strand, wherein the first strand of the yarn is secured to the second knit layer at a first location within the pocket of each raised structure and is secured to the first knit layer at a second location within the pocket of each raised structure, wherein the second strand of the yarn is secured to the first knit layer at a third location within the pocket of each raised structure and is secured to the second knit layer at a fourth location within the pocket of each raised structure, and wherein the first strand of the yarn and the second strand of the yarn form an x-shaped configuration within the pocket of each raised structure.

16. The knitted component of claim 15, wherein the first knit layer comprises a second yarn and the second knit layer comprises a third yarn that has a lower shrinkage rate than the second yarn when subjected to a stimulus.

17. The knitted component of claim 15, wherein the first strand of the yarn and the second strand of the yarn are different colors.

18. The knitted component of claim 15, wherein the second knit layer forms at least part of an exterior surface of an upper.

19. The knitted component of claim 15, wherein the yarn is visible through the second knit layer at least at some raised structures of the plurality of raised structures.

20. The knitted component of claim 15, wherein the yarn is secured to the first knit layer and the second knit layer within the pocket by tuck stitches.

* * * * *